United States Patent [19]

Sagmuller

[11] Patent Number: 4,531,051

[45] Date of Patent: Jul. 23, 1985

[54] METER REGISTER WITH INCREMENTAL INDICIA WHEEL MOVEMENT

[75] Inventor: Joseph Sagmuller, Raleigh, N.C.

[73] Assignee: Westinghouse Electric Corp., Pittsburgh, Pa.

[21] Appl. No.: 574,840

[22] Filed: Jan. 30, 1984

[51] Int. Cl.[3] ..... G06C 27/00

[52] U.S. Cl. ..... 235/1 C; 235/94 R; 235/109; 235/113; 235/133 R

[58] Field of Search ..... 235/1 C, 74, 76, 94 R, 235/94 A, 97, 61 M, 109, 113, 135–138, 140, 141, 133 R

[56] References Cited

U.S. PATENT DOCUMENTS

| | | | |
|---|---|---|---|
| 3,116,875 | 1/1964 | Wolfenden et al. | 235/139 R |
| 3,152,758 | 10/1964 | Woldenden et al. | 235/138 |
| 3,178,110 | 4/1965 | Knecht et al. | 235/144 R |
| 3,279,691 | 10/1966 | Daley et al. | 235/1 C |
| 3,398,367 | 8/1968 | Benbow | 324/103 R |
| 3,760,519 | 9/1973 | Niven | 235/113 X |
| 3,876,870 | 4/1975 | Malavazos et al. | 235/101 |
| 3,918,252 | 11/1975 | Haydon | 58/125 C |
| 4,317,385 | 3/1982 | Harvey et al. | 74/436 |
| 4,365,194 | 12/1982 | Halstead et al. | 324/116 |

*Primary Examiner*—Benjamin R. Fuller
*Attorney, Agent, or Firm*—William D. Lanyi

[57] ABSTRACT

Flat indicia wheels are used in conjunction with a Geneva-type register movement. The register utilizes transfer wheels which have an outer edge shaped to contain a plurality of scallops and cusps. Each transfer wheel is associated with a transfer disc that rotates about an adjacent shaft and whose transfer arm causes the transfer wheel to rotate a preselected angular distance by striking a peg attached to the transfer wheel. This type of movement makes possible the use of flat indicia wheels with indicia, or numerals, imposed on a flat surface of the wheel. The presentation of a flat numeral through an opening in a faceplate provides for easier reading and, when used with an automatic reading device such as a light pin, reduces the chances of an erroneous reading.

7 Claims, 12 Drawing Figures

METER REGISTER WITH INCREMENTAL INDICIA WHEEL MOVEMENT

BACKGROUND AND SUMMARY OF THE INVENTION

The present invention relates generally to meter registers and, more particularly, to registers in which flat indicia wheels are used to present numerals or other appropriate indicia at openings in a faceplate by incrementally moving the indicia wheels.

Many types of meter registers have been developed to indicate the usage of some measurable quantity. The measured value may be electrical power consumption, peak electrical demand or the consumption of another measurable substance such as water or natural gas. Meter registers in general can be classified into two basic categories: analog and digital. A typical example of an analog meter register is the electrical watt-hour meter used to measure electrical consumption in most households. An analog meter register is disclosed in U.S. Pat. No. 3,398,367 which issued to Benbow on Aug. 20, 1968. This type of meter register typically utilizes a stationary faceplate on which numerals are arranged in a circular pattern around a central point. Generally, an indicator is attached to a rotatable shaft which extends through the main plate at a point coincident with the center of the numeral arrangement. The indicator, such as a needle, rotates in direct response to electrical consumption. At any particular time, the needle may point at a particular numeral or at any location between numerals as it rotates about the central axis of its associated shaft. Usually, a plurality of shafts and associated indicators are used with each indicator being associated with a circular arrangement of numerals. Movement of the shafts of an analog meter register is controlled by a series of gears. The relative sizes of the gears are generally chosen to cause the indicators of the register to rotate in decade relationship with each other. Drive mechanisms of this type are illustrated in U.S. Pat. No. 3,398,367 and also in U.S. Pat. No. 4,365,194 which issued to Halstead et al. on Dec. 21, 1982.

One disadvantage of analog meter registers is that, at any particular point in time, the register's indicators will most probably be pointing to locations which are between the numerals of its associated faceplate. The analog nature of this type of register therefore requires some interpretation of the exact numeric value represented by the plurality of dial indicators.

Digital meter registers are generally easier to interpret than analog meter registers. In a digital register, the indicia wheels are locked into place in such a way so as to result in none of the individual indicators representing a value which lies between integers except for the first wheel which represents the least significant digit. In other words, when a particular indicator of a digital meter register changes value, it does so rapidly and then dwells for a sustained period of time at an exact integer value. In order to accomplish this intermittent movement, various mechanisms have been employed. One mechanism that results in the intermittent angular movement of the shafts of a register is the so-called Geneva drive. One type of Geneva mechanism is disclosed in U.S. Pat. No. 4,317,385 which issued to Harvey et al. on Mar. 2, 1982. That particular Geneva mechanism has a slotted Geneva wheel and a driving cam wheel which is engageable with the Geneva wheel to impart stepwise rotation thereto. When a wheel is rotated by a Geneva mechanism, it exhibits an intermittent motion which results in a stepwise rotation that dwells at a particular angular position for a period of time and then, in a relatively rapid manner, rotates to another dwell position.

The beneficial result of a register driven by a Geneva mechanism is that, at any particular instant in time, most or all of the decades of the register are stationary and easily readable. Furthermore, each of the decade positions of the register are stationary at particular integer digits which can be read through openings of a faceplate.

Meter registers which utilize Geneva mechanisms also typically utilize indicia wheels which have numerals imposed on the outer circular surface of the wheel. An example of this type of usage is discussed in U.S. Pat. No. 3,876,870 which issued to Malavazos et al. on Apr. 8, 1975. That patent relates to a postage meter and employs an indicia wheel which has the numbers, 0 through 9, disposed on the outer circumference of the wheel. Another example of indicia wheels, or drums, can be found in U.S. Pat. No. 3,918,252 which issued to Haydon on Nov. 11, 1975. That invention is a digital clock which utilizes a plurality of indicia wheels, or drums, that are used to represent hours, minutes and seconds.

Examples of a plurality of indicia drums being associated with a faceplate having a plurality of openings located therein for viewing of the numerals on the wheels are discussed in U.S. Pat. No. 3,116,875 which issued to Wolfenden et al. on Jan. 7, 1964 and U.S. Pat. No. 3,152,758 which issued to Wolfenden on Oct. 13, 1964. An example of a cyclometer meter register which utilizes indicia-bearing counterwheels, or drums, is disclosed in U.S. Pat. No. 3,178,110 which issued to Knecht et al. on Apr. 13, 1965. A particular design of indicia wheels, which is intended for use in cyclometer registers, is disclosed in U.S. Pat. No. 3,279,691 which issued to Daley et al. on Oct. 18, 1966.

When Geneva mechanisms are used in conjunction with cyclometer registers, drum-type indicia wheels are generally used. These indicia drums, which are disclosed in the patents discussed above, represent one disadvantage toward which the present invention is directed. When the numerals are disposed on the circumference of an indicia drum, the indicated numeral is not presented to an opening in a faceplate in a manner which results in the numeral appearing as a flat indicia. The use of a curved numeral, which results from the numeral being imposed on the curved outer circumference of a drum, can be disadvantageous when used in conjunction with a meter register. For example, depending on the direction of sunlight and the height of the register in relation to a person viewing the register, glare may present a problem in the accurate reading of the value represented by a plurality of such indicia wheels. More importantly, when automated reading techniques are employed by a meter reader, the curved indicia surface may introduce problems of registration between the automated reading device, such as a light pen, and the indicia wheel's surface. This problem can be especially severe when a bar code is used to represent a digital value which is presented through an opening of a meter register faceplate for the purpose of being read automatically.

The present invention provides a meter register which utilizes a type of driving mechanism which moves its indicia wheels in an intermittent fashion with rapid angular movements between preselected positions followed by dwell periods during which the indicia wheels present one of their numeric digits through an opening in an associated faceplate. Furthermore, the present invention utilizes indicia wheels which are flat discs that have the numerals imposed on one of the disc's flat surfaces. The indicia wheels of the present invention rotate about an axis which is perpendicular to the faceplate. Therefore, a numeral is presented, to an opening in the associated faceplate, which is flat when viewed through the opening. As discussed above, the presentation of a flat indicium through the opening of the faceplate is advantageous when viewed by a human observer and especially helpful when the indicium is automatically read by a device such as the type which utilizes a light pen. The numerals of the flat indicia wheels can be combined with or replaced by a bar code representation. The use of such a bar code, in conjunction with the flat indicia wheel, facilitates the automatic reading of the wheel's representation.

BRIEF DESCRIPTION OF THE DRAWINGS

The present invention will be more clearly understood from a reading of the description of the preferred embodiment in conjunction with the drawing, in which.

DESCRIPTION OF THE PREFERRED EMBODIMENT

The present invention relates generally to meter registers and, more particularly, to meter registers which utilize flat indicia wheels that are cooperatively associated with driving mechanisms which cause the indicia wheels to rotate intermittently to particular angular positions in a relatively rapid manner followed by a dwell period at each of the preselected angular positions.

Figure 1:
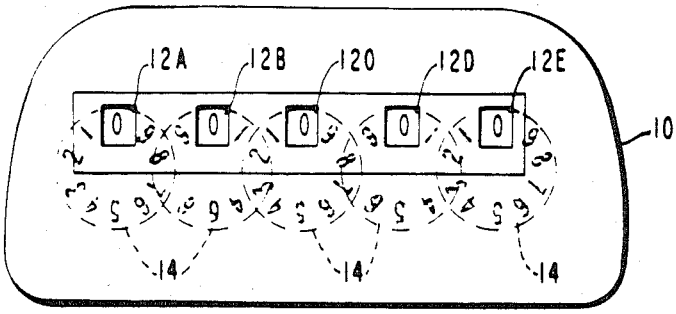
FIG. 1 illustrates a front view of the faceplate of a meter register made in accordance with the present invention.

FIG. 1 illustrates a frontal view of a meter register made in accordance with the present invention. It comprises a faceplate 10 which has a plurality of openings, 12A-12E. As illustrated in FIG. 1, the openings, 12A-12E, are located on the faceplate 10 at positions which are coincident with indicia that are inscribed on indicia wheels 14. In a decade meter register, each of the indicia wheels 14 would be inscribed with the numerals which range from 0 to 9.

As will be described in greater detail below, the indicia wheels 14 of the present invention are disposed relative to the faceplate 10 in such a way that the planar surfaces of the indicia wheels 14 are generally parallel to the faceplate 10. The placement of the indicia wheels 14 relative to the faceplate 10 in this manner provides one of the significant benefits of the present invention. By disposing a planar surface of the indicia wheels 14 parallel to the faceplate 10, the indicia which are visible through the openings, 12A–12E are presented as a flat surface when viewed through the openings. As compared to conventional cyclometers which utilize wheels with indicia disposed about their circumferences, the present invention is easier to read and more adaptable to automatic reading is easier to read and more adaptable to automatic reading techniques.

The present invention utilizes a plurality of individual components which cooperate with each other to move the indicia wheels in an incremental fashion. These components are associated in such a way that a continuous rotational movement of a shaft can be translated into a plurality of precise intermittent movements of indicia wheels during which the indicia are moved rapidly from one preselected angular position to another followed by a dwell period during which one of the indicia is located at an opening in the faceplate 10 and is easily viewable therethrough.

Figure 2:
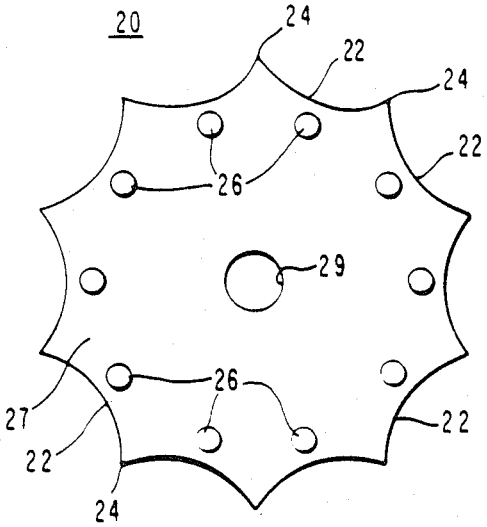
FIG. 2 shows the transfer wheel of the present invention.
Figure 3:
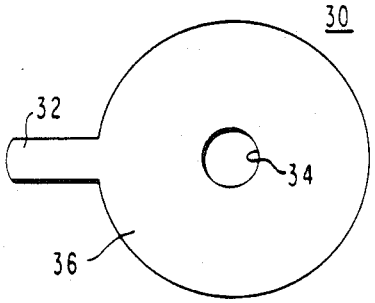
FIG. 3 shows the transfer apparatus of the present invention.
Figure 4:
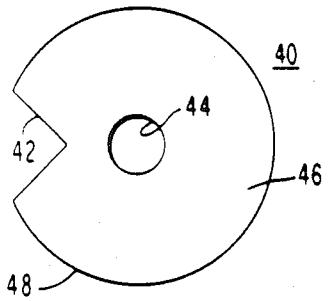
FIG. 4 shows the locking disc of the present invention.

FIGS. 2, 3 and 4 illustrate three important subcomponents of the present invention. FIG. 2 is a transfer wheel 20. It is generally flat and disc-shaped with a plurality of scallops 22 formed in its outer edge. Although the particular number of scallops 22 on the transfer wheel 20 may vary, it should be understood that, for a decade meter register, ten scallops 22 are used. Between each adjacent pair of scallops 22, a cusp 24 is formed at the intersections of adjacent scallops 22.

The transfer wheel 20 is provided with a plurality of pegs 26 which extend from one planar face 27 of the transfer wheel 20. The pegs 26 are generally perpendicular to the planar face 27. A preferred embodiment of the present invention utilizes an equal number of pegs 26 and scallops 22. Each peg 26 is disposed at an angular position around the outer periphery of the transfer wheel 20 in such a way that the peg 26 is located at an angular position equally distant from the angular positions of two adjacent cusps 24 at a point which represents the central angular position of each of the scallops 22. The transfer wheel 20 is also provided with a means for connecting it to a rotatable shaft with the shaft being generally perpendicular to the planar surface 27. In FIG. 2, this connecting means is a hole 29 through which a shaft can be extended and thereby connected to the transfer wheel 20.

FIG. 3 illustrates a transfer apparatus 30 which has a transfer arm 32 extending therefrom. The primary function of the transfer apparatus 30 is to provide a carrying means from which the transfer arm 32 can extend. In a preferred embodiment of the present invention, a central opening 34 is provided through the transfer apparatus 30 so that a rotatable shaft can be connected to the transfer apparatus 30 in a way that results in the shaft being generally perpendicular to a planar surface 36 of the transfer apparatus 30. The rotatable shaft (which is not illustrated in FIG. 3) is connected in such a way that, as the shaft rotates, the transfer arm 32 rotates about the central opening 34.

FIG. 4 illustrates a locking disc 40 which is a generally flat circular plate with a notch 42 formed in its outer edge. The locking disc 40 is also provided with a central opening 44 which permits it to be connected to a rotatable shaft with the rotatable shaft extending in a direction generally perpendicular to a planar surface 46 of the locking disc 40.

The components illustrated in FIGS. 2, 3 and 4 cooperate with each other to provide an intermittent motion of an indicia wheel as will be described in greater detail below. The transfer arm 32 is shaped to fit between adajcent pegs 26 of the transfer wheel. When the transfer wheel 20 and the transfer apparatus 30 are located proximate each other, a rotation of the transfer arm 32 engages one of the pegs 26 of the transfer wheel 20 in such a way so as to cause the transfer wheel 20 to rotate about its central opening 29. The notch 42 which is formed in the outer edge of the locking disc 40 is shaped to receive the cusp 24 of the transfer wheel 20 as the locking disc 40 and the transfer wheel 20 rotate in opposite directions about rotatable shafts which are parallel to each other. Furthermore, the outer circular surface 48 of the locking disc 40 is sized to be received within each of the scallops 22 of the transfer wheel 20. As can be seen by comparing the relative shapes of the transfer wheel 20 and locking disc 40, the locking disc 40 can prevent rotation of the transfer wheel 20 when the circular surface 48 of the locking disc 40 is disposed within a scallop 22 of the transfer wheel 20 at a time when the notch 42 is not proximate a cusp 24. However, as the notch 42 rotates about the central opening 44 of the locking disc 40 and approaches a cusp 24 of the transfer wheel 20, the transfer wheel 20 can be permitted to rotate about its central opening 29 because the cusp 24 can extend into the notch 42 during the cooperative rotation of both the transfer wheel 20 and locking disc 40. Therefore, it can be seen that the locking disc 40 is able to prevent rotation of the transfer wheel 20 when the notch 42 is at any angular position about the central opening 44 other than a position proximate one of the cusps 24.

Figure 5:
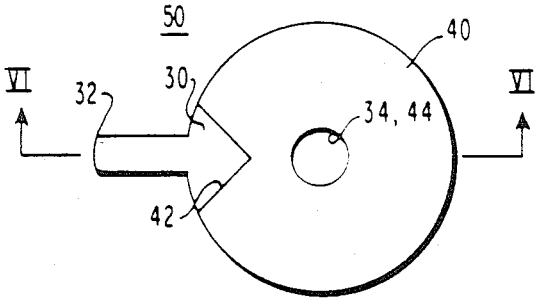
FIG. 5 shows the transfer apparatus and locking disc of the present invention associated together to form a transfer disc.

The transfer apparatus 30 of FIG. 3 and the locking disc 40 of FIG. 4 are connected together in a preferred embodiment of the present invention. When connected together, the locking disc 40 is disposed proximate the transfer apparatus 30 with their central openings, 44 and 34, respectively, aligned. In this type of configuration, their planar surfaces, 46 and 36, are arranged in parallel association. Furthermore, the notch 42 of the locking disc 40 is disposed at an angular position which coincides with the angular position of the transfer arm 32. This association between the locking disc 40 and the transfer apparatus 30 is illustrated in FIG. 5. For purposes of this discussion, the combination of a locking disc 40 and a transfer apparatus 40, as shown in FIG. 5, will be referred to as a transfer disc 50 herein. The transfer apparatus 30 is shown attached to the locking disc 40 with their central openings, 34 and 44, respectively, being aligned. Furthermore, the notch 42 is shown disposed at the same angular position as the transfer arm 32. It should be understood that, within the scope of the present invention, the transfer disc 50, which is shown as an assembly of two components in FIG. 5, can be manufactured as a one-piece device. For example, the transfer disc 50 could be molded with some suitable material, such as plastic or zinc, being used.

Figure 6:
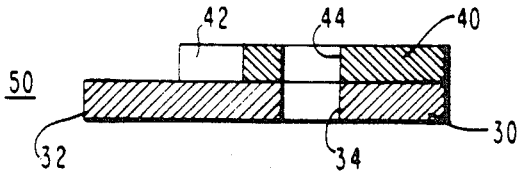
FIG. 6 is a sectional view of FIG. 5.

FIG. 6 illustrates a sectional view of the transfer disc 50 of FIG. 5. FIG. 6 illustrates the alignment of the openings, 34 and 44, along with the parallel association of the planar surfaces of the transfer apparatus 30 and locking disc 40. These two components cooperate to form the transfer disc 50 which is utilized by the present invention to cooperate with the movement of a transfer wheel (reference numeral 20 in FIG. 2).

Figure 7:
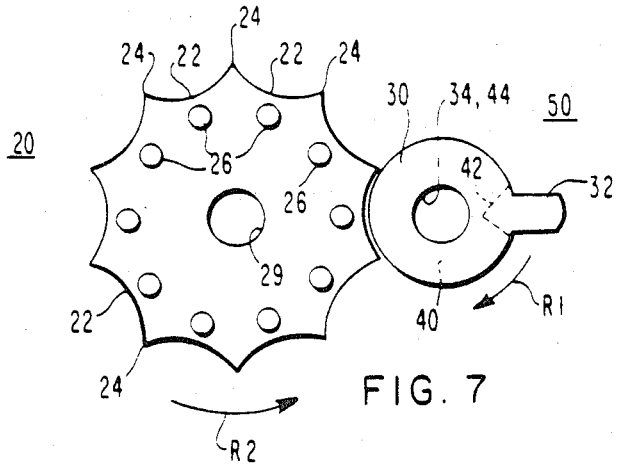
FIG. 7 illustrates a transfer wheel associated with a combination of a locking disc and a transfer arm.

FIG. 7 illustrates the cooperative association between a transfer wheel 20 and a transfer disc 50 of the present invention. For purposes of illustration, the proper rotational direction of the transfer disc 50 will be assumed to be that of the arrow R1 and the proper rotational direction of the transfer wheel 20 will be assumed to be that of the direction indicated by arrow R2. The outer circular surface of the locking disc 40 is sized to be received in each of the scallops 22 of the transfer wheel 20, as shown. Because of this relationship, the transfer disc 50 is free to rotate in the direction indicated by arrow R1 without interference from any portion of the transfer wheel 20. However, as can also be seen in FIG. 7, the transfer wheel 20 is not free to rotate in the direction indicated by arrow R2 because of the interference with the cusps 24 by the locking disc 40. Therefore, in the positions shown in FIG. 7, the transfer disc 50 is free to rotate about its central opening while the transfer wheel 20 is locked in place and is not free to rotate about its central opening 29.

It can also be seen from FIG. 7 that, as the transfer disc 50 rotates in the direction indicated by arrow R1, the transfer arm 32 will eventually pass between two adjacent pegs 26 of the transfer wheel 20 and strike one of the pegs in such a way as to cause the transfer wheel 20 to rotate in the direction indicated by arrow R2. Because of the alignment between the notch 42 and the transfer arm 32, the notch 42 will be aligned with one of the cusps 24 of the transfer wheel 20 as the transfer arm 32 impacts the peg 26. The length of the transfer arm 32 is chosen to allow the transfer arm 32 to maintain contact with the impacted peg 26 until the transfer wheel 20 is rotated a sufficient angular amount to dispose the following scallop 22 around the locking disc 40.

For purposes of more clearly understanding FIG. 7 and the later figures, it should be understood that the components and individual portions of the assembly illustrated in FIG. 7 are disposed in two distinct planes which are parallel to each other. For example, the main body of the transfer wheel 20, with its scallops 22 and cusps 24, is disposed in the same plane as the locking disc 40 with its notch 42. Similarly, the pegs 26 of the transfer wheel 20 are disposed in the same plane as the transfer apparatus 30 with its transfer arm 32. The transfer arm 32, therefore, is free to rotate above the cusps 24 as it moves, along the direction indicated by arrow R1, toward an eventual impact with a peg 26. Also, the notch 42 rotates, in the direction illustrated by arrow R1, until it eventually is proximate a cusp 24 of the transfer wheel 20. Since the transfer arm 32 and notch 42, which are locked in different planes, are aligned as shown, the notch 42 will be proximate a cusp 24 as the transfer arm 32 approaches a peg 26 prior to impact. Furthermore, as the transfer arm 32 is impacting a peg 26, the notch 42 is positioned to receive a cusp 24 that extends into the locking disc 40.

Figure 8:
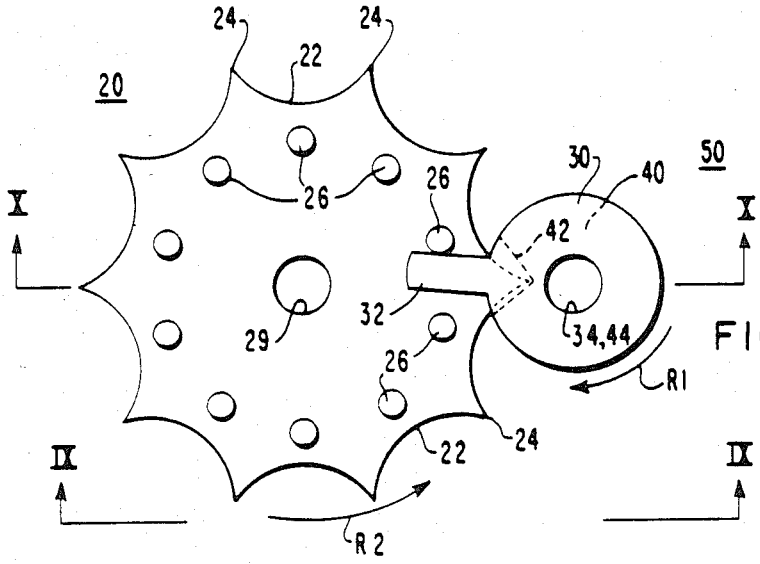
FIG. 8 illustrates the association between a transfer wheel and the transfer disc during rotation of these two associated components.

The relationship between the transfer wheel 20 and the transfer disc 50 during rotation of the transfer wheel 20 is illustrated in FIG. 8. As the transfer disc 50 rotates in the direction indicated by arrow R1, the transfer arm 32 rotates into position between two adjacent pegs 26 of the transfer wheel 20 as shown and, eventually, strikes one of those pegs 26. As the transfer arm 32 rotates into position between the pegs 26, the notch 42 also rotates into position to receive one of the cusps 24 of the transfer wheel 20. The extension of the cusp 24 into the notch 42 permits the transfer wheel 20 to rotate, in a direction indicated by arrow R2, without interference by the transfer disc assembly 50. It should be understood that the transfer wheel 20 and the transfer disc 50 are each connected to separate rotatable shafts which are associated in parallel relation with each other. The transfer wheel 20 and the transfer disc 50 are connected to their associated shafts at their respective central openings.

As the transfer disc 50 continues its rotation in the direction indicated by arrow R1, eventually the impacted peg 26 is pushed away from the region of contact with the moving transfer arm 32. As this happens, the notch 42 and its associated cusp 24 rotate away from each other and the circular portion of the transfer disc's edge again becomes associated with a scallop 22 and locks the transfer wheel 20 in position to prevent further rotation.

It should therefore be apparent that the transfer wheel 20 is moved in an intermittent manner with relatively rapid angular movement occurring during the contact of the transfer arm 32 with a peg 26 which is followed by a sustained dwell period during which time the transfer arm 32 rotates about the central axis of the transfer disc 50 prior to a subsequent impact with another peg 26 of the transfer wheel 20. The resulting motion of the transfer wheel 20 is an intermittent rapid rotational movement followed by a dwell period when the transfer wheel 20 does not rotate. It should therefore be apparent that an indicia wheel which is attached to the same rotatable shaft as a transfer wheel 20 will experience the same intermittent motion.

Figure 9:
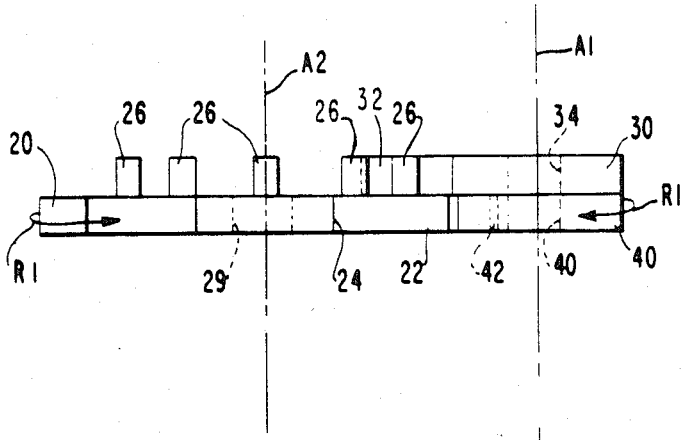
FIG. 9 is an alternative view of FIG. 8.

FIG. 9 is an alternate view of the combination illustrated in FIG. 8. FIG. 9 more clearly shows the relationship between the two planes of the transfer wheel 20 and the transfer disc 50 as discussed above. As can be seen in FIG. 9, an upper plane contains the pegs 26 and the transfer apparatus 30 with its transfer arm 32. The lower plane contains the main body of the transfer wheel 20 and the locking disc 40 with its notch 42. The various components which are disposed in each of these two planes cooperate with other components within the same plane because of the physical relationship between components which are located in different planes, but which are part of the same transfer wheel 20 or transfer disc 50. For example, the cooperation between the transfer arm 32 and the pegs 26 is caused by the relative position of the transfer arm 32 to the notch 42 and also by the relative positions of the pegs 26 with the associated cusps 24 and scallops 22. In order for the present invention to operate properly, these various relationships must be maintained. For example, as the transfer arm 32 is pushing against a peg 26, the notch 42 must be in a proper position to receive a cusp 24 in order to permit the transfer wheel 20 to rotate. This proper positioning of the notch 42 essentially unlocks the transfer wheel 20. In order for this relationship to be maintained, the pegs 26 must be positioned near the center of the scallops 22. Another important relationship between the components of the present invention is the radius of curvature of the scallops 22 and the radius of the outer edge of the locking disc 30. These two radii of curvature, although not actually identical, must be shaped in such a way that the presence of the outer surface of the locking disc within a scallop 22 will prevent rotation of the transfer wheel 20 because of the interference with the cusps 24 by the locking disc 30. Also shown in FIG. 9, are the axes of rotation, A1 and A2, of the transfer disc 50 and the transfer wheel 20, respectively. It should be understood that these axes of rotation, A1 and A2, would represent the central axes of rotatable shafts in a meter register which embodies the present invention.

Figure 10:
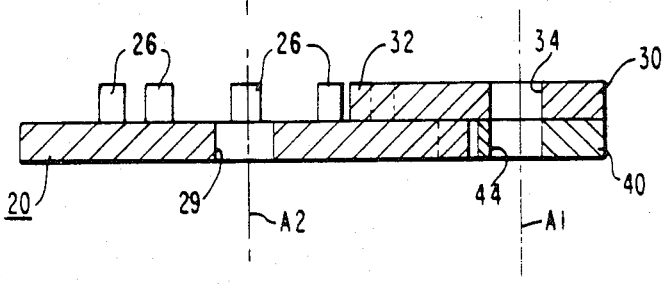
FIG. 10 is a sectional view of FIG. 8 taken through the centers of rotation of the transfer arm, locking disc and transfer wheel.

FIG. 10 shows a sectional view of the assembly of FIG. 8. It can be seen, by comparing FIGS. 8 and 10, that the transfer disc 50 comprises the transfer apparatus 30 and the locking disc 40. These two components are associated with their central openings, 34 and 44, respectively, aligned with the axis A1. It can also be seen that the transfer arm 32 extends in a direction generally perpendicular to axis A1. Furthermore, FIG. 10 illustrates the transfer wheel 20 with its pegs 26 extending in a direction generally perpendicular to its planar surfaces. The central axis A2 extends through the central opening 29 of the transfer wheel 20. Both FIGS. 9 and 10 illustrates the two planes within which the various operative components of the present invention rotate. In one plane, the transfer apparatus 30, with its transfer arm 32, rotates in cooperation with the pegs 26 of the transfer wheel 20. In the other plane, the locking disc 40 rotates in cooperation with the cusps 24 and scallops 22 of the transfer wheel 20.

Figure 11:
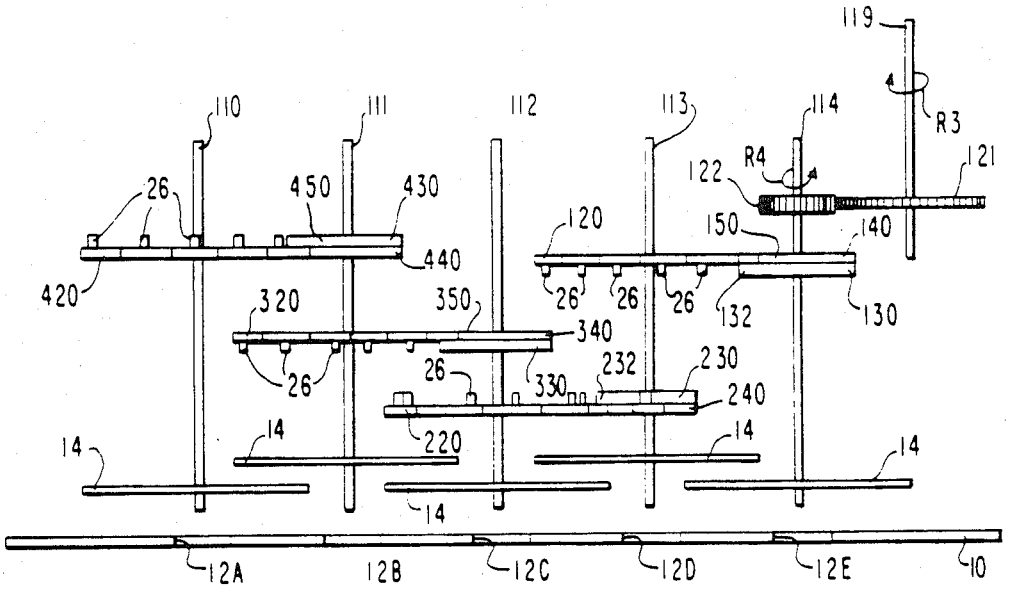
FIG. 11 shows a top view of a meter register which employs a plurality of applications of the present invention.

FIG. 11 shows a meter register assembly made in accordance with the present invention. In the front portion of the register, a faceplate 10 is shown having five openings therein. These openings, 12A–12E, are aligned with particular locations on five indicia wheels 14. The indicia wheels 14 are flat discs having a plurality of numerals imposed on one of their planar surfaces. The indicia, or numerals, are disposed an equal distance from the center of rotation of each indicia wheel 14 and at equally spaced angles around the indicia wheel's axis of rotation. Each indicia wheel is attached to a rotatable axis, 110–114. As can be seen in FIG. 11, the axes are cooperatively associated with transfer wheels 20 and transfer discs 50. Each transfer disc 50 is an association of a transfer apparatus 30 and a locking disc 40 as discussed above.

In order to more clearly describe the function of the present invention, axes 113 and 114 will be described in greater detail.

In FIG. 11, reference numerals 120, 220, 320 and 420 are used to indicate similar components that are connected to different rotatable shafts, namely shafts 113, 112, 111 and 110 respectively. Similarly reference numerals 130, 230, 330 and 430 are similar components connected to shafts 114, 113, 112 and 111, respectively, reference numerals 140, 240, 340 and 440 are similar components connected to shafts 114, 113, 112 and 111, respectively, and reference numerals 150, 350 and 450 are similar components connected to shafts 114, 112 and 111, respectively. The last two digits of similar components are identical in order to facilitate a functional description of the meter register illustrated in FIG. 11. The transfer disc which is connected to axis 114 is designated by reference numeral 150 in order to distinguish it from the other transfer discs used in FIG. 11. Similarly, the transfer apparatus and locking disc which are associated with axis 114 are described with reference numerals 130 and 140, respectively. Operation of the meter register illustrated in FIG. 11 is initiated by the rotation of shaft 119 by some means for measuring power consumption or any other measurable quantity. Shaft 119 rotates in the direction illustrated by arrow R3 and gear 121, which is connected to shaft 119, rotates similarly. The rotation of gear 121 causes associated gear 122 to rotate in an opposite direction as indicated by arrow R4. It should be understood that gear 122, transfer apparatus 130, locking disc 140 and the associated indicia wheel 14 are all connected to shaft 114 and, therefore, rotate in unison.

As the transfer arm 132 rotates about axis 114, it eventually comes into position to strike one of the pegs 26 of transfer wheel 120. As the transfer arm 132 strikes the peg 26, it causes the transfer wheel 120 to rotate about its rotatable axis 113. In the manner described above, the notch in the locking disc 140 cooperates with the cusps and scallops of transfer wheel 120 to move transfer wheel 120 one index position in a relatively rapid manner followed by a prolonged dwell at that position. In a decade register, each transfer wheel would have ten scallops and ten cusps and each rotation of the transfer wheel would represent an angular movement of 36 degrees. As can be seen from FIG. 11, transfer wheel 120 is attached to axis 113 and a movement of transfer wheel 120 would therefore result in a rotation of shaft 113. This angular movement of shaft 113 cause the transfer apparatus 230 and the locking disc 240 to rotate with it, along with the associated indicia wheel 14 which is connected to shaft 113. For every ten intermittent movements of transfer wheel 120, transfer arm 232 will be caused to engage a peg 26 on transfer wheel 220.

If each transfer wheel of the register which is illustrated in FIG. 11 is provided with ten scallops and ten cusps, the relationship between the five indicia wheels would cause each indicia wheel to move one angular movement for ten angular movements of its lower decade neighboring shaft. Therefore, the indicia wheel 14 which is associated with opening 12E would rotate ten times prior to a movement of the indicia wheel 14 which is associated with opening 12D, and so on. Therefore, the indicia, or numerals, which can be viewed through the openings, 12A–12E, of the faceplate 10 would represent a decade relationship with its neighboring indicia wheels 14.

FIG. 11 illustrates a meter register which utilizes five indicia wheels. It should be apparent from the discussion above and the register depicted in FIG. 11, that shafts 111, 112 and 113 each are connected to a transfer wheel and a transfer disc along with an indicia wheel 14. The lowest decade shaft 114, however, does not have a transfer wheel 120 because it is provided with a motive force by gear 122 which is associated with gear 121 and shaft 119. Therefore, shaft 114 only requires an indicia wheel 14 along with a transfer disc 150 that is used to cause shaft 113 to move. Also, it should be apparent from FIG. 11 that shaft 110 does not have a transfer disc attached to it. Since shaft 110 represents the highest digit of the register reading, there is no need for a transfer disc to move a higher decade shaft. The relationship between shafts in the register illustrated in FIG. 11 can be readily seen. Shaft 114 carries a transfer disc whose transfer arm causes the transfer wheel 120 of shaft 113 to rotate and shaft 113 carries a transfer disc whose transfer arm 232 causes the transfer wheel 220 of shaft 112 to rotate, and so on. Each shaft, 111–114, rotates ten times for each rotation of its associated shaft to its left.

An important feature of the present invention can be seen in FIG. 11. The indicia wheels 114, although varying in their distance from the faceplate 10, each present their indicia, or numerals, to their associated opening, 12A–12E, as a flat numeral when viewed through the openings. The advantages of this type of indicia presentation, as described above, is twofold. First, since the indicia are not on curved surfaces, the numerals will be easier to read through the openings, **12*a*–12*e***. Secondly, if the indicia are to be read by an automatic apparatus, such as a light pen connected to a computerized device, the flat presentation of the indicia to the openings is advantageous.

Figure 12:
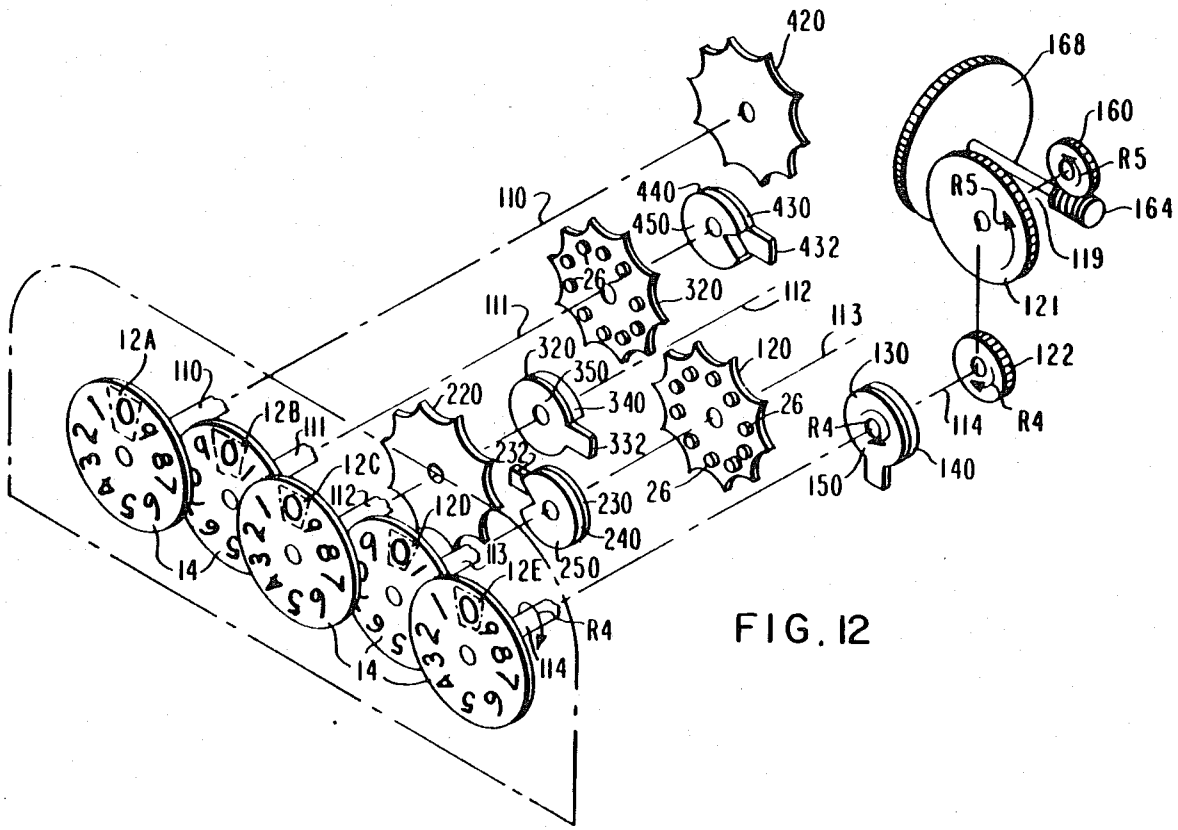
FIG. 12 is an exploded perspective view of a meter register mechanism made in accordance with the present invention.

FIG. 12 illustrates an exploded perspective view of a meter register made in accordance with the present invention. Each of the indicia wheels 14 are located relative to the openings, 12A–12E, of a faceplate so that a preselected one of the numerals on each of the indicia wheels 14 is visible through its associated opening. The indicia wheels 14 are generally flat discs with their planar surfaces disposed in generally parallel relation with the faceplate 10. Each indicia wheel 14 is attached to a rotatable shaft. For purposes of this discussion, each rotatable shaft will be assigned the reference numeral equivalent to the central axis of the shaft.

The exploded perspective view of FIG. 12 shows the central three shafts, 111–113, as having transfer wheels 20 and transfer discs 50 attached thereto along with an indicia wheels 14. Shaft 110 is shown as having only a transfer wheel 20 and an indicia wheel 14. Shaft 114 is shown as having only a transfer disc 150 and an indicia wheel 14.

By viewing FIGS. 11 and 12 together, the operation of the present invention will be more clearly understood. As shaft 114 rotates in the direction indicated by arrow R4, transfer disc 150 rotates and eventually strikes a peg 26 on transfer wheel 120 of shaft 113. After ten such rotations of transfer disc 150, transfer wheel 120 will rotate one complete revolution. For each complete revolution of shaft 113, transfer disc 250 will rotate into a position in which transfer arm 232 will strike a peg (not visible in FIG. 12) on transfer wheel 220. Similarly, for each ten revolutions of shaft 112, transfer wheel 320 of shaft 111 will be caused to rotate one complete revolution, and so on.

As can be clearly seen in FIGS. 11 and 12, the first shaft 114 does not rotate in an intermittent manner. Instead, it operates continuously because of its direct gear train relationship with shaft 119. Therefore, the indicia wheel 14, which is connected to shaft 114, rotates continually and its indicia or numerals do not dwell adjacent opening 12E. The configuration illustrated in FIGS. 11 and 12 therefore illustrates a meter register which has four indicia wheels that operate in an intermittent manner and one indicia wheel, connected to shaft 114, which operates in a continuous or analog manner. It should be apparent, however, that if it is desired to have all indicia wheels of a meter register operate in an intermittent manner, this could easily be achieved by providing an extra shaft with no indicia wheel but with a transfer disc 50 associated with a transfer wheel 20 which is connected to the first shaft. Generally, the least significant digit of a decade register is not critical and, therefore, does not require the intermittent motion followed by dwell for reading purposes.

In a typical embodiment of the present invention, as illustrated in FIG. 12, shaft 114 is connected to gear 122 and gear 122 is operatively associated with gear 121 which is connected to shaft 119. Also connected to shaft 119, is another gear 160 which is associated with a worm gear 164. Gear 160 moves in response to the rotation of the worm gear 164 and this relationship causes shaft 119 to rotate as shown by arrow R5. Worm gear 164 is typically connected to the same shaft as a primary gear 168 which is caused to rotate in response to the usage of electrical power or some other measurable quantity. The physical dimensions of the gears illustrated in FIG. 12 determine the ratio of rotations of shaft 114 to the actual usage of the measured quantity. If these gear ratios are chosen in such a way that the numerals on the indicia wheel viewed through opening 12E represent kilowatt-hours, the numerals viewed through opening 12D would represent tens of kilowatt-hours and the numerals viewed through opening 12C would represent hundreds of kilowatt-hours, and so on. If, alternatively, the gearing ratios were chosen to result in the numerals viewed through opening 12E representing tenths of kilowatt-hours, the numerals viewed through opening 12D would represent kilowatt-hours, and the numerals viewed through opening 12C would represent tens of kilowatt-hours, and so on.

The present invention provides a meter register which utilizes a Geneva-type movement that is particularly suitable for use with flat indicia wheels and which provides intermittent angular movements followed by periods of dwell. The use of the flat indicia wheels is advantageous when viewing the numerals, or indicia, through openings in a faceplate and, is especially suitable for automatic reading of the indicia by a device such as a light pen which is cooperatively associated with an automatic reading apparatus. It should be understood that indicia, such as bar coded numerals, are especially suitable for use with the present invention. Although the present invention has been described in great detail in relation to its preferred embodiment, it should be understood that alternative embodiments are within its scope.

What I claim is:

1. A register movement, comprising:

an indicator disc having a flat surface with a plurality of indicia thereon, said disc being connected to a first rotatable shaft at the center of said flat surface;

a transfer wheel being generally flat and having a scalloped edge, said transfer wheel being connected to said first rotatable shaft at the center of the transfer wheel, said scalloped edge having a plurality of cusps;

means for preventing said transfer wheel from rotating, said preventing means being shaped to fit between two adjacent ones of said cusps, said preventing means having a notch in its edge which is shaped to permit one of said cusps to extend therein, said preventing means being connected to a second rotatable shaft at the center of said preventing means, said first and second rotatable shafts being disposed parallel to each other; and means for causing said transfer wheel to rotate about its center, said causing means comprising an extension which is shaped to engage a portion of said transfer wheel, said causing means being connected to said second rotatable shaft at the center of said causing means, said portion of said transfer wheel being a gap between two adjacent pegs of a plurality of pegs attached to said transfer wheel, each of said plurality of pegs extending perpendicularly from a flat plane of said transfer wheel in a direction parallel to said first rotatable shaft.

2. A meter register comprising:

a first shaft which is rotatable about its central axis;

a flat indicia disc connected to said first shaft, said first shaft being generally perpendicular to said flat indicia disc;

a transfer wheel connected at its center to said first shaft, said transfer wheel having a plurality of scallops and a plurality of cusps formed in its outer edge, said plurality of scallops and said plurality of cusps being alternately disposed around said outer edge;

a plurality of pegs extending from said transfer wheel in a direction parallel to said central axis of said first shaft, each of said plurality of pegs being associated with a preselected one of said scallops;

transfer apparatus connected to a second rotatable shaft, said first and second shafts being generally parallel to each other;

a transfer arm connected to said transfer apparatus, said transfer arm extending from said transfer apparatus in a direction perpendicular to said second shaft;

a locking disc connected to said second shaft, said locking disc having a generally circular outer edge shaped to fit in each of said scallops, said outer edge of said locking disc having a notch shaped to receive one of said cusps, said locking disc being connected to said transfer apparatus with said transfer arm being aligned proximate said notch; and said transfer apparatus being disposed proximate said transfer wheel with said plurality of pegs being aligned in a first plane with said transfer arm, said locking disc being aligned in a second plane with said transfer wheel.

3. The meter register of claim 2, further comprising:

a faceplate disposed in parallel association with a flat surface of said flat indicia disc, said faceplate having an opening aligned with one of a plurality of indicia on said flat surface.

4. The meter register of claim 3, further comprising:

means for rotating said second shaft.

5. A utility meter register, comprising:

a first rotatable shaft and a second rotatable shaft, said first and second rotatable shafts being disposed in parallel relation with each other;

a first transfer arm connected to said first rotatable shaft, said first transfer arm extending in a generally perpendicular direction from said first rotatable shaft;

a first locking disc connected to said first rotatable shaft, said first locking disc having a generally circular edge with a notch formed in said edge, said notch being aligned with said transfer arm, said first rotatable shaft being connected to the center of a planar surface of said first locking disc; and a first transfer wheel connected to said second shaft with said second shaft being connected to the center of a planar surface of said first transfer wheel, said first transfer wheel having a plurality of scallops formed in its edge, each adjacent pair of scallops having a cusp disposed therebetween, said first transfer wheel having a plurality of pegs connected to said first transfer wheel, each of said plurality of pegs extending from said first transfer wheel in a direction which is generally parallel to said second rotatable shaft, said plurality of pegs being equal in number to said plurality of scallops, each of said plurality of pegs being associated with a preselected one of said plurality of scallops, said plurality of pegs being equally spaced apart to permit said first transfer arm to move between adjacent pairs of said plurality of pegs and strike one of said adjacent pairs of said plurality of pegs, said notch being shaped to receive one of said cusps as said first transfer arm strikes said one peg, each of said plurality of scallops being shaped to receive said generally circular edge of said locking disc in locking relation.

6. The utility meter register of claim 5, further comprising:

an indicia wheel connected to said second rotatable shaft, said indicia wheel having a flat planar surface with a plurality of indicia imposed thereon, said second rotatable shaft being connected to the center of said flat planar surface.

7. The utility meter of claim 6, further comprising:

a faceplate being generally flat and being disposed in generally parallel relation with said flat planar surface of said indicia wheel.

* * * * *